US011172794B2

(12) United States Patent
Kim

(10) Patent No.: US 11,172,794 B2
(45) Date of Patent: Nov. 16, 2021

(54) SHEET PRODUCT DISPENSER

(71) Applicant: Kimberly-Clark Worldwide, Inc., Neenah, WI (US)

(72) Inventor: SungWoo Kim, Osan-si (KR)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 53 days.

(21) Appl. No.: 16/622,604

(22) PCT Filed: Jun. 12, 2018

(86) PCT No.: PCT/US2018/037022
§ 371 (c)(1),
(2) Date: Dec. 13, 2019

(87) PCT Pub. No.: WO2018/231776
PCT Pub. Date: Dec. 20, 2018

(65) Prior Publication Data

US 2021/0145223 A1 May 20, 2021

Related U.S. Application Data

(60) Provisional application No. 62/519,216, filed on Jun. 14, 2017.

(51) Int. Cl.
*A47K 10/38* (2006.01)
*A47K 10/32* (2006.01)

(52) U.S. Cl.
CPC .... *A47K 10/3818* (2013.01); *A47K 2010/324* (2013.01); *A47K 2010/3206* (2013.01); *A47K 2010/3233* (2013.01)

(58) Field of Classification Search
CPC ..... A47K 10/3818
See application file for complete search history.

(56) References Cited

U.S. PATENT DOCUMENTS 5,273,184 A 12/1993 Rizzuto
5,310,083 A 5/1994 Rizzuto
5,542,568 A * 8/1996 Julius ..... B65D 83/0805 221/63
5,718,353 A 2/1998 Kanfer et al.
5,765,718 A 6/1998 Grasso et al.
5,868,346 A 2/1999 Cobos
(Continued)

FOREIGN PATENT DOCUMENTS

CN 101518426 A 9/2009
GB 2458920 A 10/2009
(Continued)

OTHER PUBLICATIONS

Baywest, "Lot of 2 Wagon Wheel Bay West 88400 Dispenser Toilet Paper Tissue 4 Roll Black", https://picclick.com/Lot-Of-2-Wagon-Wheel-Bay-West-88400-361945422450.html#&gid=1&pid=3.
(Continued)

*Primary Examiner* — Gene O Crawford
*Assistant Examiner* — Ayodeji T Ojofeitimi

(57) ABSTRACT

A rolled paper product dispenser having a dispensing nozzle with inner and outer portions that cooperate to enable single sheet dispensing and resist sheet product falling back into the dispenser and out of reach of a user.

4 Claims, 8 Drawing Sheets

(56) References Cited

U.S. PATENT DOCUMENTS

| | | | | |
|---|---|---|---|---|
| 6,129,240 | A | 10/2000 | Morand | |
| 6,182,858 | B1 | 2/2001 | Hartog | |
| 7,731,057 | B2 | 6/2010 | Evans et al. | |
| 8,573,398 | B2 | 11/2013 | Reinke et al. | |
| 8,857,614 | B2 | 10/2014 | Gordon | |
| 9,101,250 | B2 | 8/2015 | Ray | |
| 9,549,646 | B2 | 1/2017 | Ray et al. | |
| 2008/0283546 | A1* | 11/2008 | Neveu | A47K 10/3818 221/45 |
| 2009/0114669 | A1 | 5/2009 | Decker et al. | |
| 2010/0133287 | A1 | 6/2010 | Tramontina et al. | |
| 2012/0097697 | A1 | 4/2012 | Gehring | |
| 2014/0246450 | A1 | 9/2014 | Marietta-Tondin et al. | |
| 2014/0367400 | A1 | 12/2014 | Crudge et al. | |
| 2015/0048105 | A1 | 2/2015 | Gordon | |
| 2015/0272406 | A1 | 10/2015 | Hill et al. | |
| 2016/0000276 | A1 | 1/2016 | Rozek et al. | |

FOREIGN PATENT DOCUMENTS

| | | | |
|---|---|---|---|
| WO | 0002475 | A1 | 1/2000 |
| WO | 13057565 | A2 | 4/2013 |
| WO | 16018202 | A1 | 2/2016 |
| WO | 16181373 | A2 | 11/2016 |

OTHER PUBLICATIONS

Georgia-Pacific Professional, "Centerpull Towel & Wiper Dispenser SKU#GPC54050", http://www.dobmeierjanitorialsupplies.com/catalog-by-product-category/industrial-cleaning-equipment-supplies/industrial-cleaning-equipment-catalog/soap-towel-wipe-dispensers/paper-towels-towel-dispensers/paper-towel-dispensers/Centerpull-Towel-&-Wiper-Dispenser-SKU-GPC54050/.

Vondrehle, "VonDrehle 2644 Mini Center Pull Towel Dispenser", https://www.webstaurantstore.com/video-3230/vondrehle-mini-center-pull-towel-dispenser.html.

* cited by examiner

SHEET PRODUCT DISPENSER

This application claims priority from U.S. provisional Patent Application Ser. No. 62/519,216 filed on Jun. 14, 2017, the entire contents of which are incorporated herein by reference.

TECHNICAL FIELD

This disclosure generally relates to dispenser for dispensing rolled paper products.

BACKGROUND OF THE DISCLOSURE

Systems dispensing consumable products are ubiquitous in many environments today. For example, bath tissue dispensers are commonplace in many private, semi-private and public washrooms. Given this widespread adoption, discouraging excessive use of the paper products dispensed by such dispensers helps control the cost of operating facilities in which these dispensers are located, including, for example, reducing the amount of paper products required to be purchased and reducing the costs associated with servicing and maintaining the dispensers, e.g., refilling the dispensers with additional paper products.

SUMMARY OF THE DISCLOSURE

In general, the subject matter of this specification relates to a paper product dispenser for roll-based sheet-by-sheet dispensing. One aspect of the subject matter described in this specification can be implemented in systems that include a dispenser having a body having a product holding area for the product, and a front cover pivotally hinged to a back cover to allow the front cover to transition between an open position and a closed position; a dispensing nozzle located in the front cover and proximate to a core of the product when the front cover is in the closed position, wherein: the dispensing nozzle has an inner portion and an outer portion with the inner portion being closer to the roll when the front cover is in the closed position than the outer portion; the inner portion has a plurality of fingers with each of the plurality of fingers having a floating finger end and at least two finger ends are not connected to each other, and wherein the plurality of fingers define a cone shape of the inner portion and the at least two finger ends define at least part of a pathway through which for sheets of the product can be dispensed; and the outer portion has an opening that at least partial overlaps the pathway.

Particular embodiments of the subject matter described in this specification can be implemented so as to realize one or more of the following advantages. For example, the dispenser, by virtue of single sheet dispensing, promotes portion control and reduces excessive use of the paper products, e.g., bath tissue, which also reduces the cost associated with operating the dispenser.

Center pulled products, as described below, are often dispensed through a small opening in the dispenser's front cover. In some instances the paper product may fall back down inside the dispenser, e.g., if a sheet of the paper product is perforated or torn prematurely, for example, before it passes through the dispenser opening to be accessible to the user. This occurrence can render the dispenser inoperable as the dispensing opening is often too small to allow the user to reach inside the dispenser to retrieve the next sheet.

To address this issue, the dispenser described herein includes a dispensing nozzle (e.g., opening) with a valve structure that allows the paper product sheets to pass out of the dispenser during a dispensing operation but resists the sheet reversing direction and falling back down inside the dispenser and out of reach of the user. This avoids the user being frustrated from not being able to use the dispenser and avoids unnecessary maintenance or service visits to open the dispenser and feed the paper product back through the opening for access by the user.

The details of one or more implementations of the subject matter described in this specification are set forth in the accompanying drawings and the description below. Other features, aspects, and advantages of the subject matter will become apparent from the description, the drawings, and the claims.

Figure 1A:
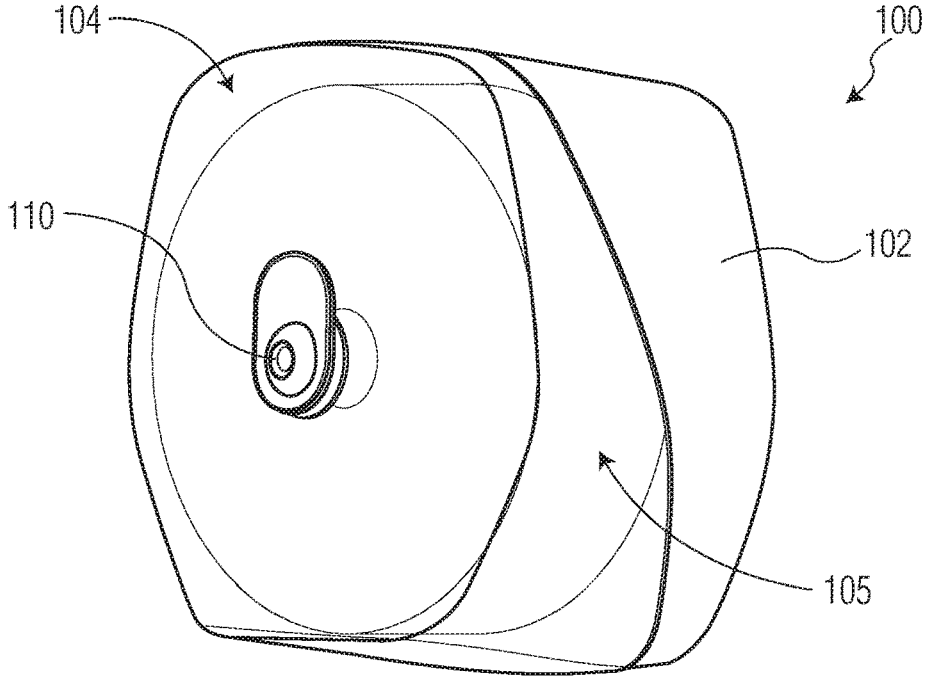
FIG. 1A is a representation of an example product dispenser.

Repeat use of reference characters in the present specification and drawings is intended to represent the same or analogous features or elements of the disclosure.

DETAILED DESCRIPTION OF THE DISCLOSURE

The present disclosure generally relates to a dispenser that provides single sheet (e.g., one at a time) dispensing from a roll, e.g., bath tissue roll.

Dispensers aimed at curbing excessive consumption of the paper product are sometimes referred to roll portion control dispensers. One technique to achieve such portion control is by dispensing only a single sheet at a time. This may require coordination between the paper product roll design (e.g., the type of perforations separating the individual sheets on the roll, the width and length of each sheet, etc.) and the dispensing system, including the dispensing nozzle, through which the sheets are dispensed.

To that end, the dispensing system, including the dispensing nozzle, described herein has a is matched to the paper product size, i.e., sheet length, width, bulk and/or composition, to apply sufficient force and cause the sheets, which are separated by perforations, to tear apart as they are pulled through for single sheet dispensing. For example, the user grabs a portion of a sheet from the roll protruding from the dispenser opening and pulls the sheet. The force required to pull the protruding sheet through the opening exceeds the force required to tear the perforations separating it from the next sheet on the roll. Thus as the sheet is pulled through the opening it separates from the next sheet, for single sheet dispensing, and leaves the next sheet partially protruding from the dispenser opening for the user to grab for the next dispensing operation.

FIG. 1A is a representation of an example product dispenser 100. The dispenser 100 can be, for example, a bath tissue dispenser 100, a hand towel dispenser 100, a wiper or wiper dispenser 100, or the like for rolled paper products. Paper products describes sheet materials made from cellulose fibers (e.g., wood pulp), synthetic fibers (e.g., polypropylene) or some combination thereof, and include, for example, bath tissue, paper towels and wipers. A rolled product is an interconnected sheet product that is wound around a core, and a center pull product is a rolled product that is unwound from its core outward towards its periphery.

Figure 1B:
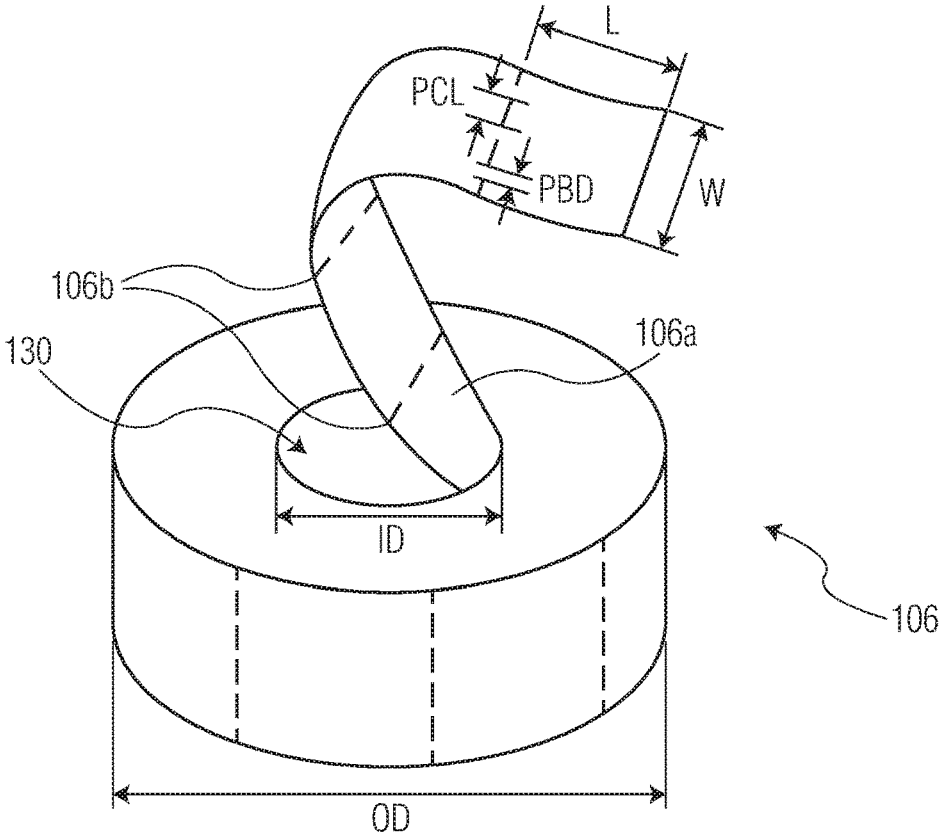
FIG. 1B is a representation of an example roll of paper product.

FIG. 1B is a representation of an example roll of paper product 106 (e.g., a rolled paper product that is center pulled). The paper product 106 includes a plurality of product sheets 106*a* separated by perforations 106*b*. As described below in greater detail, the perforations 106*b* have a break force, which is exceeded when the product 106 is pulled through the dispenser 100 in a dispense operation to separate, one-by-one, the sheets 106*a* for single sheet dispensing. In some implementations, the paper product 106 (in roll form) has an outer diameter (OD) of 190-250, in particular 195-220 millimeters and inner diameter (ID) of 30-80, in particular 40-45 millimeters, a basis weight (e.g., air dry basis per sheet) of 20-35, in particular 23-30 grams per square meter, a per sheet length (L) of 150-250, in particular 200-230 millimeters, a per sheet width (W) of 90-150, in particular 110-125 millimeters, and a perforation cut length (PCL) of 1-5, in particular 1.85-4 millimeters when a perforation bond distance (PBD) is 1.0 millimeters. In some implementations, for example, the bonding ratio (=1−perforation ratio) is 15%-50%, in particular 20%-35%. The sheets 106*a* are pulled through the dispenser 100 and dispensed along the axis parallel to their length L.

Figure 1C:
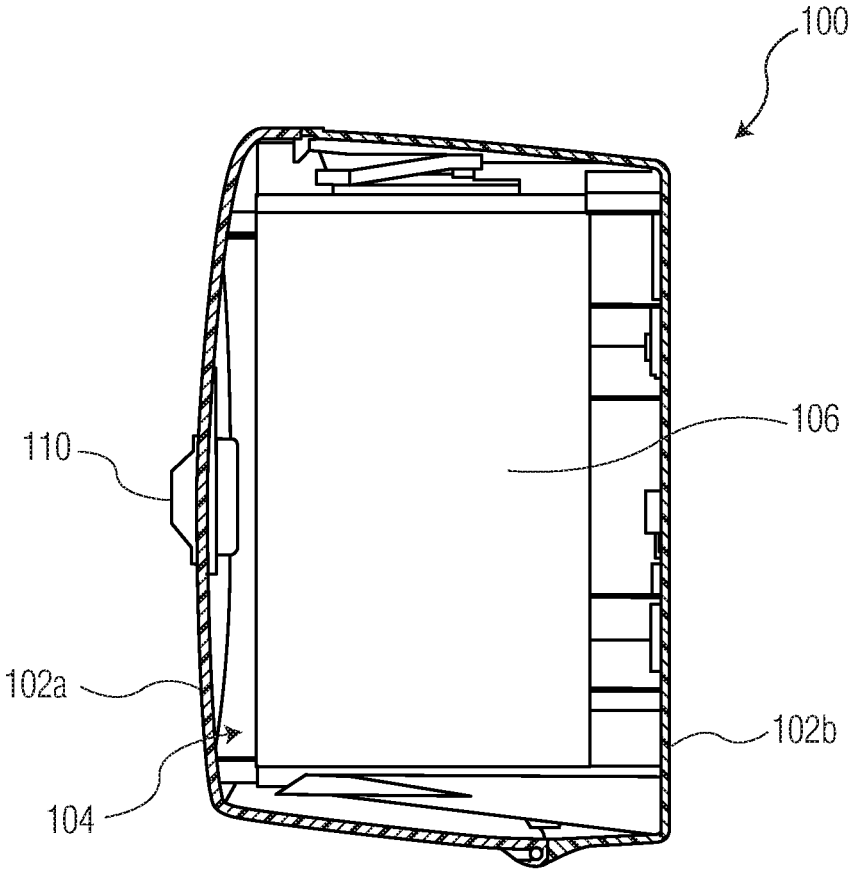
FIG. 1C is a cutaway representation of the example dispenser with the front cover of the body in a closed position.
Figure 1D:
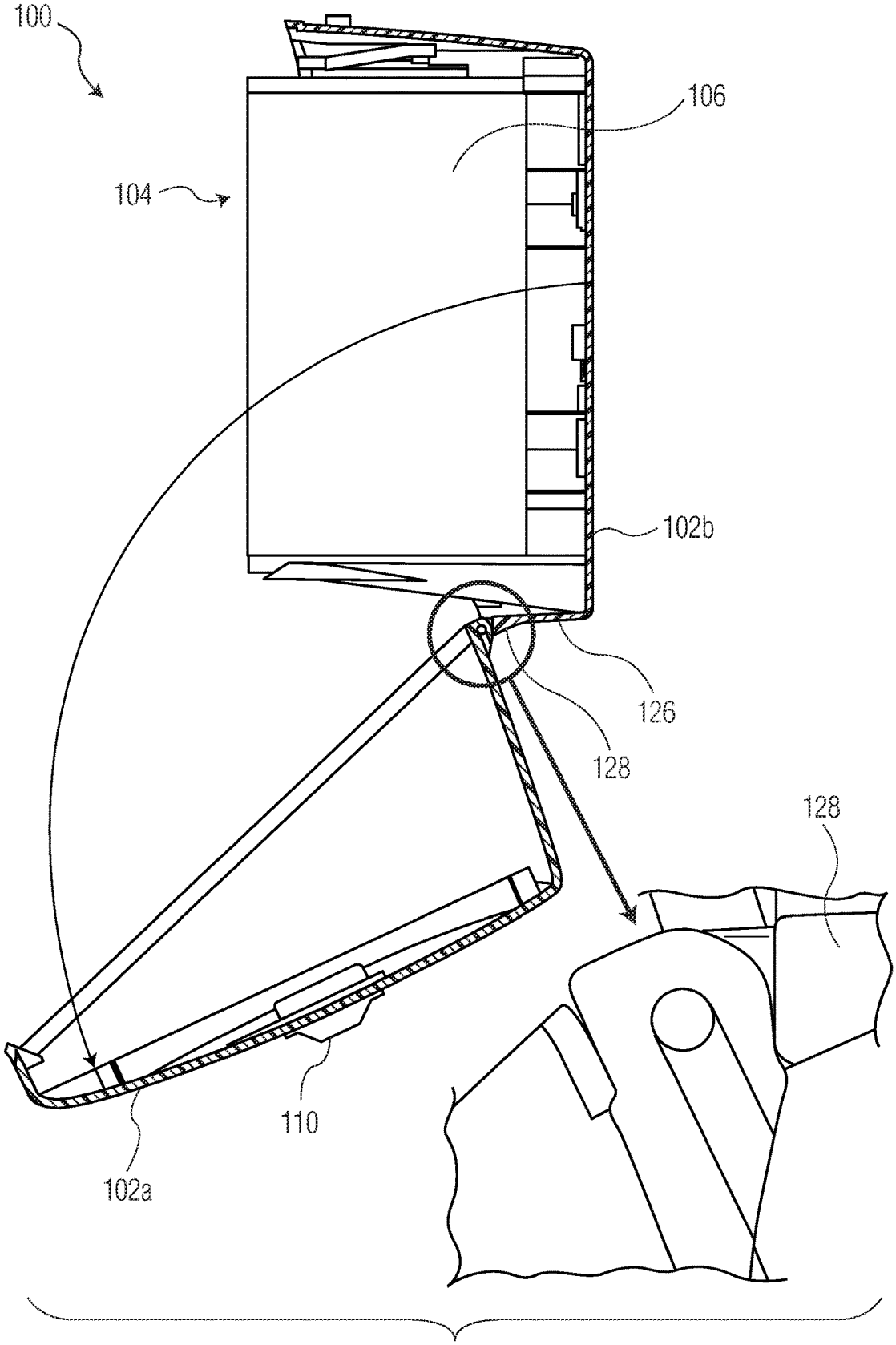
FIG. 1D is a cutaway representation of the example dispenser with the front cover of the body in a closed position to and in an open position to show the product holding area.

The dispenser 100 includes a body 102, e.g., a composite or metal housing, with an outer surface (e.g., an exterior surface of the body 102). The dispenser 100 also includes a product holding area 104 to hold (e.g., rolled) paper product 106, as shown in FIGS. 1C and 1D, respectively, which are cutaway representations of the dispenser 100 with the front cover 102*a* of the body 102 in an closed position to and in an open position to show the product holding area 104.

In some implementations, the product holding area 104 is a space or cavity within the body 102 in which the product 106 can be positioned for dispensing, and can be accessed by rotating or pivoting the front cover 102*a*, from a closed position, away from the back cover 102*b* (e.g., the wall mounted portion) by a hinge or the like to an open position. For example, the front cover 102*a*, when in the closed position, and the back cover 102*b* define the product holding area 104.

Figure 2A:
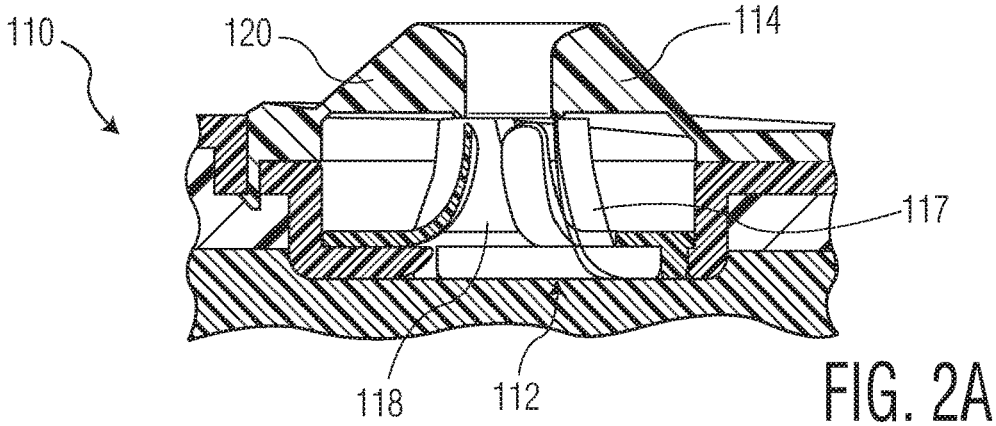
FIG. 2A is a first side cutaway representation of the dispensing nozzle.
Figure 2B:
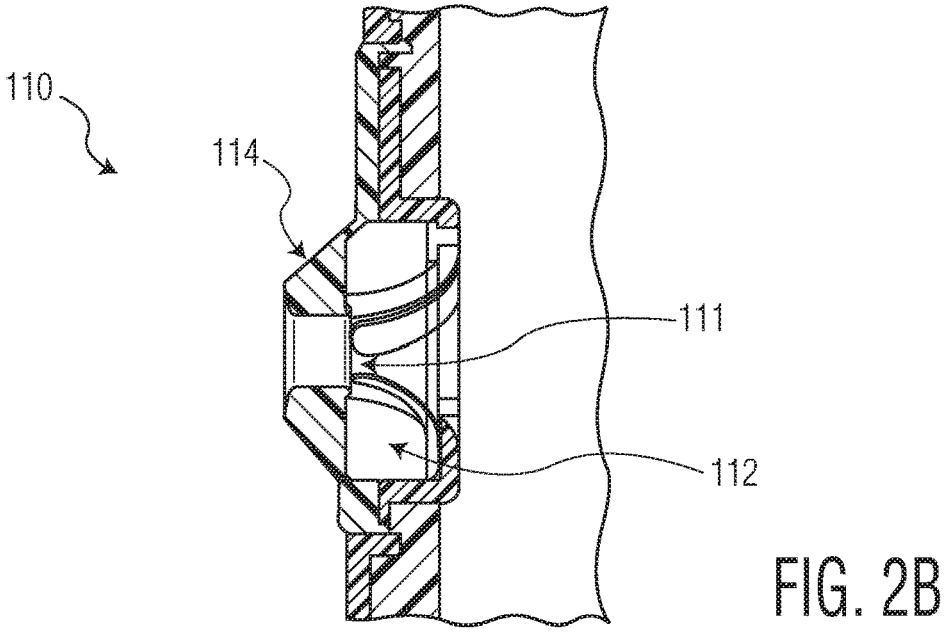
FIG. 2B is a second side cutaway representation of the dispensing nozzle.
Figure 2C:
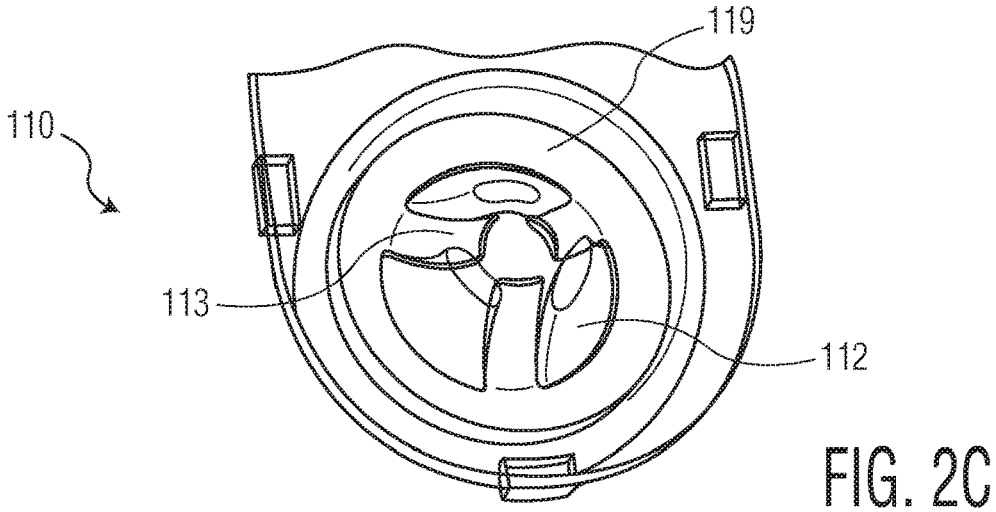
FIG. 2C is a perspective representation of the dispensing nozzle.

The dispenser 100 also includes a dispensing nozzle 110, which operates to dispense a portion of the product 106 (e.g., one sheet 106*a* at a time), as described with reference to FIGS. 2A, 2B, and 2C. FIG. 2A is a first side cutaway representation of the dispensing nozzle 110, FIG. 2B is a second side cutaway representation of the dispensing nozzle 110 and FIG. 2C is a perspective representation of the dispensing nozzle 110. The dispensing nozzle 110 is located in the front cover 102*a* and, in some implementations, proximate to a core of the product 106 when the front cover 102*a* is in the closed position. Thus the dispensing nozzle 110 provides an opening in the front cover 102*a* through which the product 106 can be moved from the product holding area 104 to a region external to the dispenser 100 for access and use by a user. As described above, in some implementations the dispensing nozzle 110 is positioned to align with and be proximate the center axis of the product 106, e.g., aligned to the axis centered in the open core of the rolled product 106. In other implementations, the dispensing nozzle 110 can be positioned anywhere on the front cover 102*a* or sides 105 of the dispenser 100, e.g., proximate the periphery of the roll 106. For example, for a rolled product 106 that unwinds from its periphery, the dispensing nozzle 110 is positioned on the side 105 of the dispenser 110.

Figure 2D:
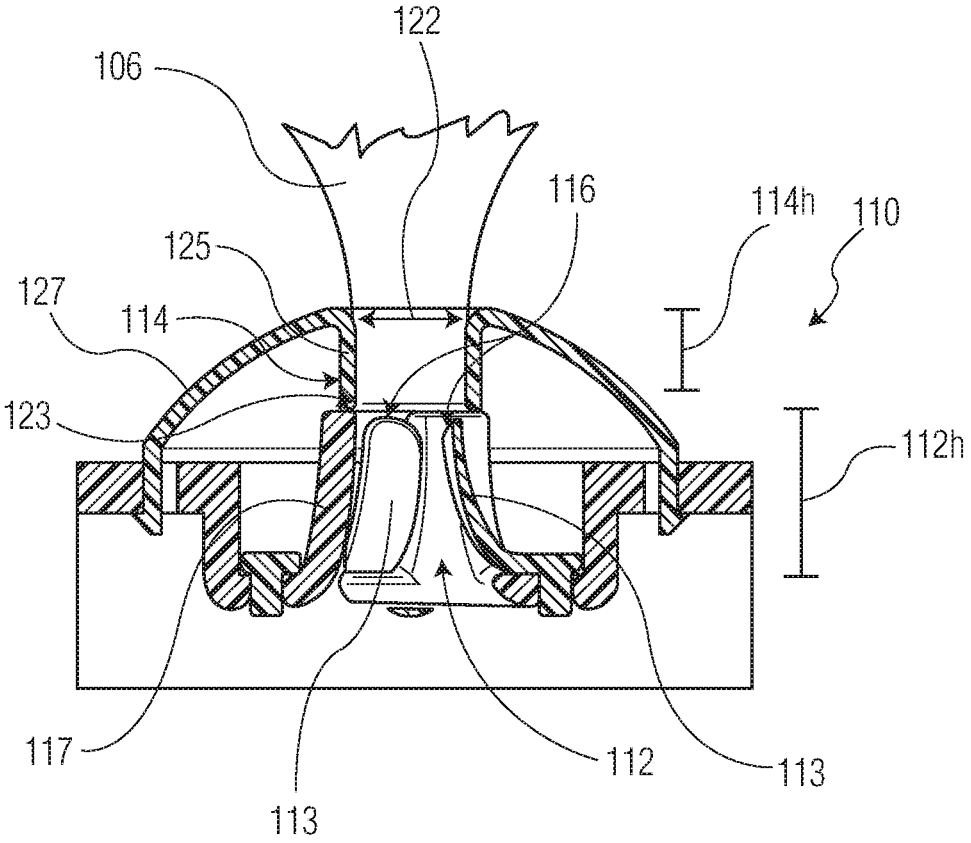
FIG. 2D is a cross sectional representation of the dispensing nozzle with a sheet product extending out through the dispensing nozzle.

More particularly, FIG. 2D shows a cross sectional representation of the dispensing nozzle 110 with a sheet product 106*a* extending out through the dispensing nozzle 110. In this normal operation the sheet 106*a* passes through the nozzle 110 pulling the next sheet partially through the nozzle 110 before perforating from that next sheet, which allows the next sheet to protrude from the dispensing nozzle 110 to let a user easily grab it. Thus in this operation the next sheet is partially pulled through the dispensing nozzle 110 before it perforates from the sheet 106*a* being pulled by the user. To this end, the force applied by the primary dispensing nozzle 110 on the sheets 106*a* as they pass through is designed to cause a sheet 106*a* being pulled by a user to perforate from the next sheet 106*a* (by exceeding the force required to perforate the sheets) only after the next sheet 106*a* has partially passed through the dispensing nozzle 110.

In some implementations, this force is applied by friction between the sheet 106*a* and the dispensing nozzle 110 is based, at least in part, on the diameter of the dispensing nozzle 110 and its configuration relative to the size, basis weight and/or composition of the paper 106 passing through it. For example, with a conically shaped dispensing nozzle 110 the narrowing of the dispensing nozzle 110 as the product 106 passes through increases the frictional force applied on the product 106 as the diameter of the dispensing nozzle 110 decreases as the sheet 106*a* is pulled through until the sheet 106*a* perforates. Thus, after perforation, it is desired that the next sheet 106*a* is partially in the product holding area 104 and partially extending out through the dispensing nozzle 110.

Because the dispenser 100 and product 106 are designed to work together to ensure proper dispensing, the dispenser 100 also discourages unauthorized roll use as rolls not made to the appropriate specifications, e.g., as described above, will either perforate prematurely (e.g., on a regular basis) or not perforate at all.

In some implementations, the dispensing nozzle 110 has an inner portion 112 and an outer portion 114 with the inner portion 112 being closer to the roll 106 when the front cover 102*a* is in the closed position than the outer portion 114. The inner and outer portions 112, 114 can be separate pieces or a single piece. The inner and outer portions 112, 114 cooperate to define a path through which the product 106 is dispensed from the product holding area 104 to the user. The inner portion 112 can have a height 112*h*, for example, ranging from 10-20, in particular 13-18 mm and the outer portion 114 can have a height 114*h* ranging from 5-12, in particular 7-10 mm. In some implementations, the height 112*h* of the inner portion 112 is greater than the height 114*h* of the outer portion 114.

In some implementations, the inner portion 112 has a plurality of fingers 113 with each of the plurality of fingers 113 having a floating finger end 116 and at least two finger ends 116 are not connected to each other. For example, in some implementations, no finger ends 116 are connected to any other finger end 116. The plurality of fingers 113 define, at least in part, a pathway 111 through which the product 106 is dispensed. In some implementations, the fingers 113 define a cone shape (e.g., a quasi-cone shape, for example, a concave cone) for this pathway 111 with the wide end of the cone 118 being closer to the product holding area 104 than the narrow end of the cone 120. For example, the wide end of the cone 118 has a diameter or width ranging from 8-25, in particular 10-15 mm, and the narrow end of the cone 120 has a diameter or width ranging from 4-12, in particular 6-9 mm, and the fingers 113 have a height ranging from 5-15, in particular 9-13 mm. In some implementations, the fingers 113 define a cylindrical pathway with a constant or varying, or combination thereof, diameter from the wide end 118 to the narrow end 120.

The number of fingers 113 can vary. For example, in some implementations, there are three fingers 113 evenly spaced 120 degrees apart along a circle formed by the plurality of fingers 113. Generally there are at least two fingers. The fingers 113 can be made of, for example, a composite or metallic material. In some implementations, the fingers 113 can deflect or flex slightly, e.g., to expand outwardly to temporarily increase the diameter of the narrow end of the cone 120, as the product 106 is pulled through the nozzle 116, but generally are semi-rigid members, e.g. hold their own shape and position and have some resistance to any change thereof. At least two or all fingers 113 can be, for example, completely separated from one another but have a common base 119. Because at least two of the fingers 113 are separated, e.g., have separate finger ends 116 or are completely separate with a common base, they are able to deflect, as described above. In addition, or alternative to, the diameter or (diameters of the cone defined by the fingers 113), the degree of deflection can be selected to apply the force necessary to perforate the sheets 106*a*.

Figure 2E:
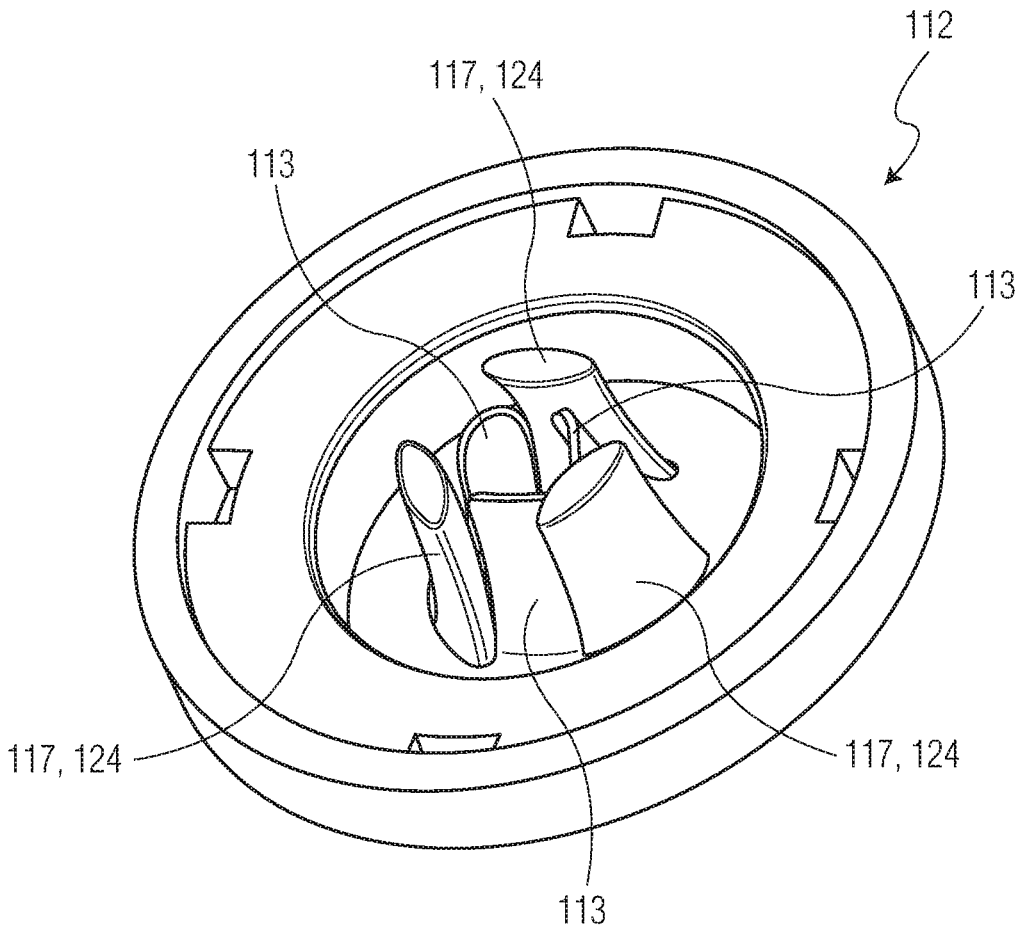
FIG. 2E is a perspective representation of the secondary member of the dispensing nozzle.

In some implementations, the inner portion 112 includes a secondary member 117, as shown in FIG. 2E, which is a perspective representation of the secondary member 117 of the dispensing nozzle 110. The secondary member 117 has a fingered structure similar to that of the inner portion 112 except that its secondary fingers 124 are positioned to encompass the fingers 113 and be placed to overlap then open regions in the inner position (i.e., cover the space between the fingers 113). Thus, in some implementations, the secondary fingers 124 may define a quasi-cone shape surrounding the quasi cone shape defined by the plurality of fingers 113. For example, the secondary fingers 124 are positioned along a circle where such circle has a diameter greater than the largest diameter or width of the outer portion 114. In some implementations, the secondary fingers 124 have a height ranging from 10-20, in particular 12-17 mm. In some implementations, the wide end of the quasi-cone shape defined by the secondary fingers have a diameter or width ranging from 10-20, in particular 13-18 mm, and the narrow end of the quasi-cone shape defined by the secondary fingers have a diameter or width of 5-10, in particular 6-9 mm.

The outer portion 114 has an opening 122 that at least partial overlaps the pathway 111. The opening 122 has a diameter or width, for example ranging from 5-10, in particular 6-9 mm. In some implementations, the opening 122 is centered on the pathway 111 while in other implementations the opening 122 is offset from the pathway 111. The outer portion 114 can be made from the same material as the inner portion 112 or from a different material. In some implementations, the diameter of the secondary member 117 is greater than that of the opening 122.

The opening 122 has an entry end 123 and an exit end 125. The entry end 123 is closer to the inner portion 112 than the exit end 125 and the entry end 123 is situated in an entry plane 127. In some implementations, the finger ends 116 do not cross the entry plane 127 such that the fingers 113 do not extend into the outer portion 114. In other implementations, the fingers 113 can extend into the outer portion 114.

As described above, it is undesirable for the product 106 fall back inside the dispenser 100, e.g., into the product holding area 104. To avoid this problem dispenser can have an opening 122 with a diameter or width larger than that of the inner portion 112 (e.g., narrow end of the cone 120) and/or the fingers 113 can deflect inwardly to narrow the pathway 111 diameter if the product 106 is moved back towards the product holding area 104. More specifically, as the product 106 moves from the inner portion 112 to the wider outer portion 114 (e.g., opening 122) during a dispensing operation the product 106 is able to expand into a less crumpled or constricted form, as the product 106 is squeezed or compressed to be able to pass through the inner portion 112 and then able to return to a larger form in the wider outer portion 114. Thus if the product 106 begins to fall (or is pushed) back down into the inner portion 112 it must once again be compressed to fit into the narrower inner portion 112. The force needed for this compression, and the greater frictional forces between the product 106 and the narrower inner portion 112, as compared to that between the product 106 and the wider outer portion 114, resist the product 106 moving back into the dispenser 100. Also, in some implementations, when the product 106 begins to fall back inside the dispenser 100, the product 106 is caught between the gaps created between the inner portion 112 and the outer portion 114.

Moreover, given that the product 106 may engage the finger ends 116 as it is compressed back into the narrower inner portion 112 the finger ends 116 may grab the product 106 and be pulled or deflect inwardly, thereby further narrowing the narrow end of the cone 120 making it more difficult for the product 106 to fall back into the dispenser 100. Additionally, as the product 106 tries to move back into the dispenser 100, it may try to expand out into the region between the fingers 113 and get trapped between the fingers 113 and the secondary fingers 124, which also resists such backward movement of the product 106.

As described above, the front cover 102*a* can be hinged to the back cover 102*b*, as shown in FIG. 1D. In some implementations, the front cover 102*a* is hinged to the back cover 102*b* proximate a bottom edge 126 of the back cover 102*a*. The back cover 102*b*, or dispenser 100 more generally, can include a hinge stop 128 to limit how wide/far the front cover 102*a* can pivot open. For example, the hinge stop 128 can be a mechanical obstruction that engages and restricts a bottom portion of the front cover 102*a* from pivoting past a certain point, e.g., restricts the front cover from opening past 115 degrees.

Figure 3:
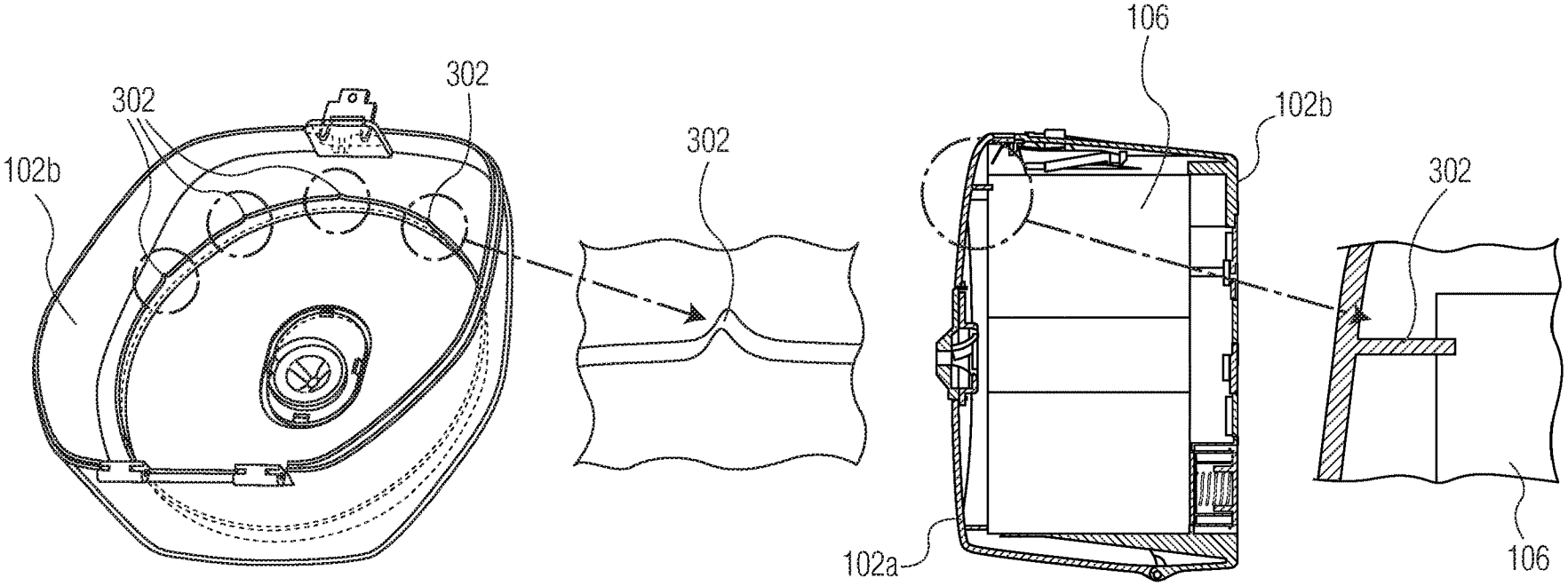
FIG. 3 shows representations of an example product support structure.

FIG. 3 shows representations of an example product support structure 302. The dispenser 100 includes a product support structure 302 that provides support for center pulled roll products as the product 106 is depleted and becomes thin at its periphery and susceptible to collapsing. For example, the product support structure 302 can be positioned proximate the periphery of product side of the front cover 102*a*, the back cover 102*b* or both, and can include multiple engagement points or areas that press against or insert into the product 106 near its periphery when the front cover 102*a* is in the closed position. The product support structure 302, in function, holds the periphery of the product 106 to keep it from collapsing as it is depleted.

Figure 4:
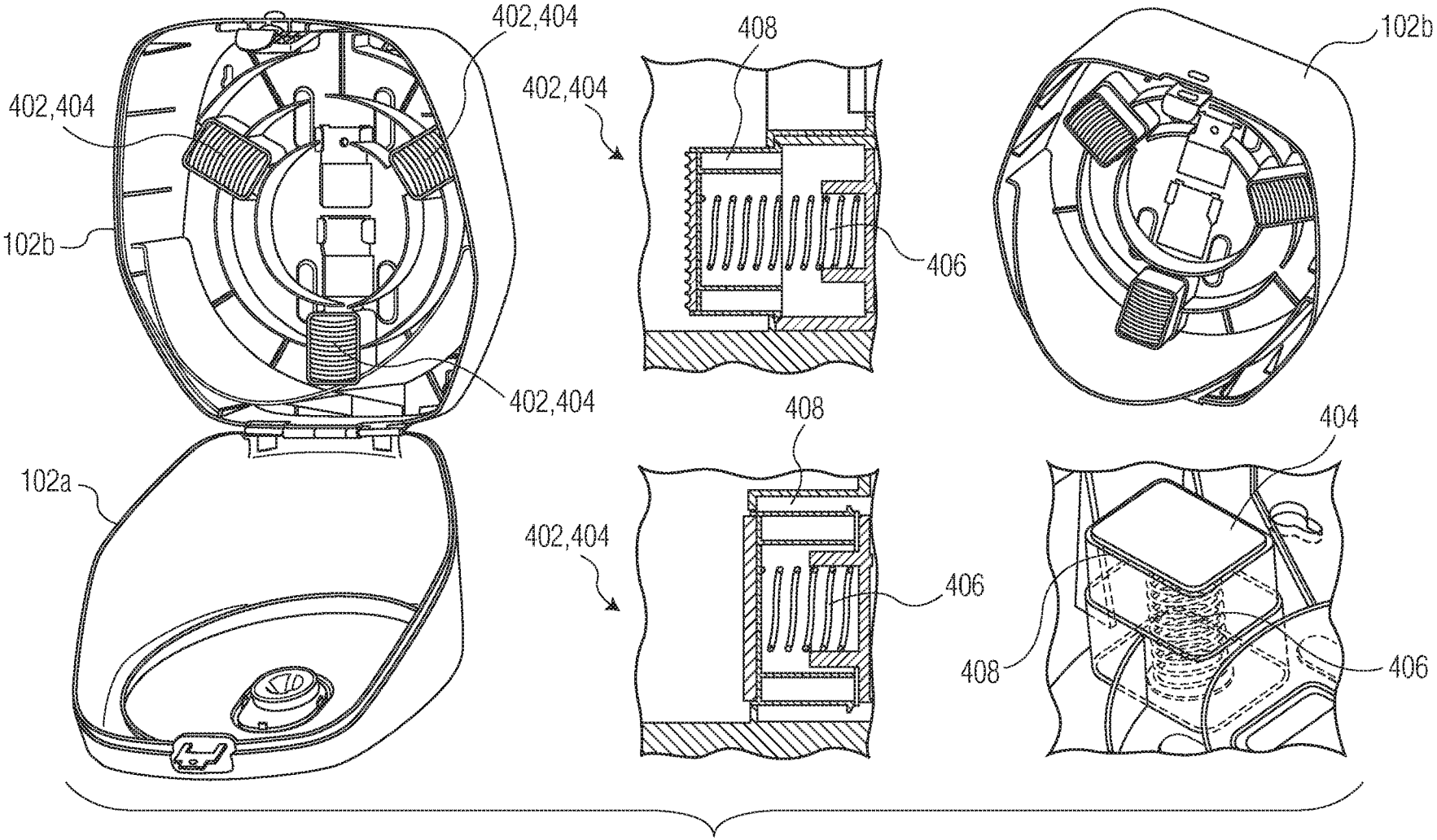
FIG. 4 shows representations of an example forward biasing device.

FIG. 4 shows representations of an example forward biasing device 402. The dispenser 100 includes a forward biasing device 402 to push the product 106 towards the front cover 102*a*, when in the closed position, and also, like the support structure 302, helps to prevent the product 106 from collapsing, while otherwise positioning the product 106 for proper dispenser operation. In some implementations, the forward biasing device 402 includes a plurality of biasing members 404 positioned on the back cover 102*b*. Each biasing member 404 includes a biasing device 406 and product contact device 408. In some implementations, the product contact device 408 is made from an elastic material, e.g., silicone rubber, and has a textured, e.g., wavy, surface to cause friction between the product contact device 408 and the paper product 106. In some implementations, this textured surface can create a higher frictional surface, as compared to a comparable flat surface. The biasing device 406 can be, for example, a spring 406 or other resilient member that engages the back cover 102*b* on one end and engages the product contact device 408 on the other and biases the product contact device 408 away from the back cover 102*b*. In this way, the biasing members 404, when the front cover 102*a* is in the closed position, push the product 106 towards the front cover 102*a* to guide the product 106 into its desired position for dispensing and support the product 106 during dispensing, e.g., helping to prevent the product 106 from collapsing or shifting during dispensing, thereby promoting proper dispenser 100 operation.

EMBODIMENTS

Embodiment 1. A dispenser for a center-pulled rolled product comprising:

a body having a product holding area for the product, and a front cover pivotally hinged to a back cover to allow the front cover to transition between an open position and a closed position;

a dispensing nozzle located in the front cover and proximate to a core of the product when the front cover is in the closed position, wherein:

the dispensing nozzle has an inner portion and an outer portion with the inner portion being closer to the roll when the front cover is in the closed position than the outer portion;

the inner portion has a plurality of fingers with each of the plurality of fingers having a floating finger end and at least two finger ends are not connected to each other, and wherein the plurality of fingers define a cone shape of the inner portion and the at least two finger ends define at least part of a pathway through which for sheets of the product can be dispensed; and the outer portion has an opening that at least partial overlaps the pathway.

Embodiment 2. The dispenser of embodiment 1, wherein the plurality of fingers comprises at least three fingers.

Embodiment 3. The dispenser of any preceding embodiment, the opening has a first diameter and the pathway has a circular cross section with a second diameter, wherein the first diameter is greater than the second diameter.

Embodiment 4. The dispenser of embodiment 3, wherein the opening has an entry end and an exit end, wherein the entry end is closer to the inner portion than the exit end and the entry end is situated in an entry plane, and wherein the at least two finger ends do not cross the entry plane.

Embodiment 5. The dispenser of any preceding embodiment, wherein the at least two finger ends are spaced at least 120 degrees apart along a circle formed by the plurality of fingers.

Embodiment 6. The dispenser of any preceding embodiment, wherein the inner portion has a height and the outer portion has a height, and the height of the inner portion is greater than the height of the outer portion.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A dispenser for a center-pulled rolled product comprising:

a body having a product holding area for the product, and a front cover pivotally hinged to a back cover to allow the front cover to transition between an open position and a closed position;

a dispensing nozzle located in the front cover and proximate to a core of the product when the front cover is in the closed position, wherein:

the dispensing nozzle has an inner portion and an outer portion with the inner portion being closer to the roll when the front cover is in the closed position than the outer portion;

the inner portion has a plurality of fingers with each of the plurality of fingers having a floating finger end and at least two finger ends are not connected to each other, and wherein the plurality of fingers define a cone or quasi-cone shape of the inner portion and the at least two finger ends define at least part of a pathway through which for sheets of the product can be dispensed; and the outer portion has an opening that at least partial overlaps the pathway, and the opening has a first diameter and the pathway has a circular cross section with a second diameter, wherein the first diameter is greater than the second diameter and the opening has an entry end and an exit end, wherein the entry end is closer to the inner portion than the exit end and the entry end is situated in an entry plane, and wherein the at least two finger ends do not cross the entry plane.

2. The dispenser of claim 1, wherein the plurality of fingers comprises at least three fingers.

3. The dispenser of claim 1, wherein the at least two finger ends are spaced at least 120 degrees apart along a circle formed by the plurality of fingers.

4. The dispenser of claim 1, wherein the inner portion has a height and the outer portion has a height, and the height of the inner portion is greater than the height of the outer portion.

* * * * *